US008021725B2

(12) United States Patent
Fu et al.

(10) Patent No.: US 8,021,725 B2
(45) Date of Patent: Sep. 20, 2011

(54) COATED MEDIA FOR IMPROVED OUTPUT STACKING PERFORMANCE

(75) Inventors: Xulong Fu, San Diego, CA (US); Chang Park, Sungnam-si (KR); Christine E Steichen, Escondido, CA (US); Ronald J Selensky, Poway, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1121 days.

(21) Appl. No.: 11/726,864

(22) Filed: Mar. 22, 2007

(65) Prior Publication Data

US 2008/0233316 A1 Sep. 25, 2008

(51) Int. Cl.
*B41M 5/00* (2006.01)

(52) U.S. Cl. ..... 428/32.21; 428/32.22; 428/32.31; 428/32.34; 427/243

(58) Field of Classification Search ..... 428/32.21, 428/32.22, 32.31, 32.34; 427/243
See application file for complete search history.

(56) References Cited

U.S. PATENT DOCUMENTS

| | | | | |
|---|---|---|---|---|
| 6,177,239 | B1 | 1/2001 | Wang et al. | |
| 6,187,521 | B1 | 2/2001 | Wang et al. | |
| 6,358,306 | B1 | 3/2002 | Hanada et al. | |
| 6,465,081 | B2 | 10/2002 | Sarkar et al. | |
| 2002/0008752 | A1 * | 1/2002 | Tokunaga et al. | 347/106 |
| 2003/0142192 | A1 * | 7/2003 | Niu et al. | 347/105 |
| 2006/0115633 | A1 | 6/2006 | Steichen et al. | |
| 2006/0115634 | A1 | 6/2006 | Park et al. | |

FOREIGN PATENT DOCUMENTS

| | | | |
|---|---|---|---|
| EP | 1331103 | | 7/2003 |
| EP | 1331103 | A2 | 7/2003 |
| EP | 1705028 | | 9/2006 |
| WO | WO9852765 | | 11/1998 |
| WO | 2006-049761 | A2 | 11/2006 |

* cited by examiner

*Primary Examiner* — Betelhem Shewareged

(57) ABSTRACT

The present invention is drawn to a coated substrate for ink-jet ink printing. The substrate can have an ink-receiving coating on the imaging side. On the opposite, or back, surface, the substrate can have two coatings: a curl control coating and a photo feel coating designed to provide scratch resistance. The curl control coating can be nearest the substrate, with the photo feel coating coated over the curl control coating. The photo feel coating can have a contact angle greater than about 90 degrees and a water vapor transport rate of greater than about 5 g/m$^2$/12 hour.

27 Claims, No Drawings

COATED MEDIA FOR IMPROVED OUTPUT STACKING PERFORMANCE

BACKGROUND OF THE INVENTION

Papers used for ink-jet printing have typically included high-quality or wood-free papers designed to have high ink absorptivity. These papers are functionally good for ink-jet printing because the ink-jet inks may be absorbed readily and dry quickly. However, such papers often do not allow for a crisp or sharp image. Thus, in order to attain enhanced print quality and image quality as in a photograph, special media has been developed to work with aqueous inks. For example, various coated papers (art paper, coat paper, cast-coat paper, etc.) have been prepared by coating an ink-receiving layer on a paper substrate. Additionally, recording sheets have been prepared by coating an ink-receiving layer on paper or other supports, e.g., transparent or opaque plastic film supports. An example of such specialty media utilizes a micro-porous ink absorptive layer. Though micro-porous media provides a relatively good substrate with respect to certain image quality properties, one drawback that is encountered with the faster printing speeds are stacking defects, as a result of stacking more than one printed media before the ink has dried.

As digital imaging becomes more popular, and ink-jet output devices continue to push photo printing speeds, it has become increasingly important for ink-jet prints to be able to be stacked in printer output trays without causing color bleed (ink migration), color shifting, hazing (a reduction in the black optical density of a printed image), or sticking to adjacent media sheets, regardless of the type of coating used. In other words, as a byproduct of rapid printing speeds, printed media must often be stacked before the printed image is sufficiently dry to prevent ink migration, color shifting, or hazing. Though this problem is especially prevalent when using micro-porous media, it can be a problem with nearly all other types of media as well, depending on the ink, substrate, ink loading of the image, stacking time, and print speed selected for use.

DETAILED DESCRIPTION OF THE PREFERRED EMBODIMENT(S)

Before the present invention is disclosed and described, it is to be understood that this invention is not limited to the particular process steps and materials disclosed herein because such process steps and materials may vary somewhat. It is also to be understood that the terminology used herein is used for the purpose of describing particular embodiments only. The terms are not intended to be limiting because the scope of the present invention is intended to be limited only by the appended claims and equivalents thereof.

It must be noted that, as used in this specification and the appended claims, the singular forms "a," "an," and "the" include plural referents unless the context clearly dictates otherwise.

As used herein, "liquid vehicle" or "ink vehicle" refers to the fluid in which colorants can be dispersed (pigments) or solvated (dyes) to form ink-jet inks in accordance with embodiments of the present invention. Many liquid vehicles and vehicle components are known in the art. Typical liquid vehicles can include a mixture of a variety of different agents, such as co-solvents, buffers, biocides, sequestering agents, viscosity modifiers, and water. The liquid vehicle can carry other solids as well, such as latex particulates, plasticizers, etc.

"Raw base paper" includes any unextruded or uncoated paper that includes fibers, fillers, additives, etc. Examples of fillers and additives include wood, clay, kaolin, calcium carbonate, gypsum, titanium oxide, talc, alumina trihydrate, magnesium oxide, minerals, synthetic fillers, natural fillers, and combinations thereof.

"Substrate" includes any base material that can be coated in accordance with an embodiment of the present invention, such as paper substrates and the like. Further, pre-coated substrates, such as polymeric coated substrates, swellable media, or micro-porous media, can also be used in embodiments of the present invention as well. In one embodiment, the core of the substrate is raw base paper. The raw base paper in this application can act as a moisture reservoir, and can therefore be absorptive.

As used herein, "water vapor transport rate" or "water vapor transmission rate" indicates a value taken from the following test: immediately after printing liquid ink on a front surface of a first coated media sheet, a second coated media sheet of the same type is stacked over the first substrate (back surface of the second substrate stacked on the printed front surface of the first substrate). Nine additional substrates are stacked on the second substrate, for a total of ten substrates stacked on the printed substrate. The weight loss of the printed media is then calculated after 12 hours to calculate how much liquid was transmitted out of the first media sheet. Typically, stacking with an impermeable layer prevents ink carrier moisture loss to a large degree out of the printed media sheet. The greater the moisture loss, typically, the less of the stacking image defect is observed, though slow moisture loss can be effective in some embodiments.

"Colorant" can include dyes, pigments, and/or other particulates that may be suspended or solvated in a liquid vehicle in accordance with embodiments of the present invention. Dyes are typically water soluble and pigments are typically not water soluble. Pigments that can be used include self-dispersed pigments and pigments that are dispersed by other additives. Self-dispersed pigments include those that have been chemically surface modified with a charge or a polymeric grouping. This chemical modification aids the pigment in becoming and/or substantially remaining dispersed in a liquid vehicle. The pigment can also be a more standard pigment that utilizes a separate dispersant (which can be a polymer or an oligomer or a surfactant) in the liquid vehicle.

As used herein, a plurality of components may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 0.01 to 2.0" should be interpreted to include not only the explicitly recited values of about 0.01 to about 2.0, but also include individual values and sub-ranges within the indicated range. Thus, included in this numerical range are individual values such as 0.5, 0.7, and 1.5, and sub-ranges such as from 0.5 to 1.7, 0.7 to 1.5, and from 1.0 to 1.5, etc. This same principle applies to ranges reciting only one numerical value. Furthermore, such an interpretation should apply regardless of the breadth of the range or the characteristics being described.

Before the present invention is disclosed and described, it is to be understood that this invention is not limited to the particular process steps and materials disclosed herein because such process steps and materials may vary somewhat. It is also to be understood that the terminology used herein is used for the purpose of describing particular embodiments only. The terms are not intended to be limiting because the scope of the present invention is intended to be limited only by the appended claims and equivalents thereof.

With this in mind, it has been recognized that it would be advantageous to provide a coated substrate for ink-jet printing which can accommodate increased printing speeds and ease of use (e.g. unattended printing) while still maintaining the high quality of the printed image. In an embodiment of the present invention, a coated substrate for ink-jet ink printing can comprise an imaging side and an opposing back side, wherein the imaging side comprises a micro-porous coating formulated for accepting an ink-jet ink composition, and the back side comprises a coating formulated for preventing curling of the media, e.g. a curl control coating, and an additional coating formulated for providing scratch resistance. The additional coating, or photo feel coating, can have a contact angle greater than about 90 degrees and a water vapor transport rate of greater than about 5 $g/m^2/12$ hours. In one aspect, the photo feel coating can have a contact angle greater than about 90 degrees and a water vapor transport rate of greater than about 20 $g/m^2/12$ hours.

In one embodiment, the coated substrate can be ink-jet ink printing media. In a further embodiment, the ink-jet printing media can be photo paper. The photo paper can be glossy or semi-glossy. A barrier coating can be included in the coated substrate. Such barrier coating can be situated between the imaging side of the substrate and the ink-receiving layer so as to prevent passage of an ink into the paper substrate material.

A method for making a printing media for ink-jet printing can also include applying certain coatings to a substrate. An ink-receiving layer can be applied to an imaging side of the substrate. On the opposing back side of the substrate, a curl control layer can be coated, and a photo feel layer including polymeric beads can be coated over the curl control layer. In one embodiment, the curl control layer and the photo feel layer can be applied simultaneously, for example, by using a curtain coater. In a specific example, the photo feel layer can be applied to a coating weight of about 0.5 $g/m^2$ to about 5 $g/m^2$. In another example, the curl control layer can be applied to a coating weight of about 15 $g/m^2$ to about 50 $g/m^2$. In a more specific example, the photo feel layer can be applied to a coating weight of about 0.5 $g/m^2$ to about 5 $g/m^2$ and the curl control layer can be applied to a coating weight of about 15 $g/m^2$ to about 50 $g/m^2$. The method can further include applying a barrier layer to the imaging side of the substrate. The ink-receiving layer can then be applied on the barrier layer.

In accordance with these embodiments, various details are provided herein which are applicable to each of the printing media and associated methods. As such, general discussion of any one of these embodiments is relevant to the other embodiments.

Thus, in accordance with embodiments of the present invention, the imaging side can include a micro-porous ink-receiving layer comprising inorganic particulate-based coating. The ink-receiving layer can be applied directly to a substrate, or can be applied to a barrier coating. The barrier coating, if present, can be configured to prevent fluid passage from the ink-receiving coating to the substrate and/or to adjust or control the finished product surface appearance and gloss. Therefore, in one embodiment, the barrier coating can be in direct contact with the substrate. In a further embodiment, the barrier coating can be coated directly on the substrate or the raw base paper and the ink-receiving layer can be coated directly on the barrier coating.

The substrate can be a variety of materials. Most substrate materials are known in the art. Non-limiting examples of materials that can be used as substrate include filled- and non-filled raw base paper, which may include fibers, fillers, additives, etc. Examples of fillers and additives include wood, clay, kaolin, calcium carbonate, gypsum, titanium oxide, talc, alumina trihydrate, magnesium oxide, minerals, synthetic fillers, natural fillers, and combinations thereof.

The curl control layer can be coated on the back side of the substrate and can be configured to prevent curling of the coated substrate. Non-limiting examples of materials that can be used in a curl control layer include pigments such as calcium carbonate, clay, aluminum trihydroxide, and binders such as starch, protein, polyvinyl alcohol, and latex (e.g. styrene-butadiene rubber, polyvinyl acetate, acrylates). The curl control layer can also include additives. Such additives can be included for purposes of altering properties of the pre-coated liquid, e.g. viscosity, surface tension, pH, or can be added for purposes of modifying or adding to the properties of the coating itself. The curl control layer or coating can be configured to prevent or control curl of the fully coated substrate so that it remains close to flat in one predetermined condition to substantially all environmental conditions before, during, and after the imaging process.

The back side can further comprise a photo feel coating. In one embodiment, the coating can be configured to provide scratch resistance so that stacked media does not damage the stacked images due to movement between the coated substrates. In one embodiment, the photo feel coating can include polymeric beads and a binder. Non-limiting examples of binders that can be used for the photo feel coating include starch, protein, gelatin, modified gelatin, polyvinyl alcohol, polyvinyl acetate, styrene butadiene, modified polyvinyl alcohol, methyl cellulose, polyvinyl pyrolidone, polyethylene oxide, polyvinyl acetal, modified polyvinyl acetal, styrene/methacrylate copolymers, acrylates, methacrylates, and combinations thereof. Non-limiting examples of polymeric beads include polyethylene, polyamide, polystyrene, polymethacrylate, polyacrylate, polypropylene, and combinations thereof. If such beads are present, sizes ranging from 0.01 μm to 30 μm are typical. In one embodiment, the polymeric beads can be of sizes ranging from 5 μm to 30 μm. Although any coating weight with the noted properties is encompassed by the invention, in one embodiment, the photo feel layer can have a coating weight of about 0.5 $g/m^2$ to about 5 $g/m^2$.

The photo feel coating, besides offering scratch resistance, can also prevent and/or reduce color bleed, color shifting, and/or hazing. As ink-jet inks include solvents, the ink colorant is set by the evaporation of the ink solvents. The noted defects can be a result of stacking imaged media before the ink solvents have had adequate opportunity to evaporate. Such defects can be reduced and/or prevented when the photo feel coating is less wettable than the imaging side coating. As mentioned, the photo feel layer can have a contact angle of greater than about 90 degrees. In a further embodiment, the contact angle of the photo feel layer can be greater than about 110 degrees. The photo feel coating or layer can also provide an area or a route for the ink solvents to evaporate from the ink-receiving layer. In one embodiment, the photo feel layer can have a vapor transport rate of greater than about 5 g/m$^2$/12 hours, and further greater than 20 g/m$^2$/12 hours. In a further embodiment, the vapor transport rate can be greater than about 25 g/m$^2$/12 hours. In still a further embodiment, the vapor transport rate can be greater than about 30 g/m$^2$/12 hour. These vapor transport rates, along with the reservoir capability of the raw base paper, can work together to allow vapor to pass the photo feel layer and be collected safely with the back side of the raw base paper which can act as a moisture reservoir to collect the moisture from the imaged media without significant image quality artifacts becoming apparent. It has been found that for best results with stack performance, the moisture transport rate from the printed substrate during the first four hours can be of importance. In one aspect, and with the disclosed breathable photo coatings, at least 70 wt % of the moisture from the imaged substrate can be removed in the first four hours following printing. In another aspect, greater than 85 wt % can be removed.

It is noted further that the photo feel coating can be configured to be permeable to moisture vapor. In one embodiment, the photo feel coating can be configured so that there are pores therein, provided by the coating, particulates, inter particulate spaces, etc. Thus, vapors from adjacently stacked printed media can pass through this photo feel coating at a rate that improves print quality of previously printed media. Specifically, by allowing the vapors to pass into the back side of adjacently stacked media, image quality can be retained. Conversely, by trapping vapors within ink printed media, e.g., by stacking with non-breathable media, image quality can be significantly reduced, causing bleeding and other undesirable image quality artifacts on the printed image.

In accordance with embodiments of the present invention, various coating techniques can be implemented as may be desirable or practical. For example, a coating solution can be prepared and be coated on a substrate by any suitable technique for the application of coating composition(s). For example, a substrate can be coated by spray coating, dip coating, cascade coating, swirl coating, rod coating, roll coating, blade coating, slot die coating, curtain coating, air knife coating, and/or by using other known coating techniques. The thickness selected for each coated layer can depend upon the particular requirement or application, as would be ascertainable by one skilled in the art. Further, multi-layer coatings can be implemented, taking into account viscosity of the various coating solutions.

EXAMPLES

The following examples illustrate embodiments of the invention that are presently known. Thus, these examples should not be considered as limitations of the present invention, but are merely in place to teach how to make the best-known compositions of the present invention based upon current experimental data. As such, a representative number of compositions and their method of manufacture are disclosed herein.

Example 1

Curl Control Coating

A curl control coating composition can be formulated by mixing the following components of Table 1:

TABLE 1

| Component | Parts by Weight |
|---|---|
| Calcium carbonate | 100 parts |
| Polyvinyl alcohol | 18 parts |
| Cross-linking agent | 2 parts |
| Plasticizer | 1 part |

This composition can be coated on a substrate to a coat weight of 35 g/m$^2$. Such coat weight can be modified based on final product curl requirements.

Example 2

Photo Feel Coating 1

A photo feel coating composition can be formulated by mixing the following components of Table 2:

TABLE 2

| Component | Parts by Weight |
|---|---|
| Polyamide bead particles (20 μm) | 50 parts |
| Polyvinyl alcohol | 50 parts |
| Cross-linking agent | 3 parts |

This composition can be coated on a substrate to a coat weight of 1.5 g/m$^2$. Such application can be simultaneous with a curl control coating, such as in Example 1, by using a two layer curtain coater. Alternatively, a two-pass coating process can be used.

Example 3

Photo Feel Coating 2

A photo feel coating composition can be created by mixing the following components of Table 3:

TABLE 3

| Component | Parts by Weight |
|---|---|
| Polyamide bead particles (10 μm) | 50 parts |
| Talc pigment | 25 parts |
| Acrylic latex | 25 parts |

This composition can be coated on a curl control layer to a coat weight of 1 g/m$^2$. Such application can be completed using coating processes such as rod, roll, blade, slot die, or curtain coater.

Example 4

Photo Feel Coating 3

A photo feel coating composition can be created by mixing the following components of Table 4:

TABLE 4

| Component | Parts by Weight |
|---|---|
| Polyethylene bead particles | 75 parts |
| Calcium carbonate | 25 parts |

TABLE 4-continued

| Component | Parts by Weight |
|---|---|
| Polyvinyl alcohol | 25 parts |
| Cross-linking agent | 3 parts |
| Low density polyethylene emulsion | 1 part |

This composition can be coated on a curl control layer to a coat weight of 3 g/m$^2$. Such application can be completed using a rod coater.

Example 5

Test Data

A substrate with a curl control coating and a photo feel coating, consistent with Example 2, was compared to a photo paper with a polyethylene back layer. The substrates were printed with an HP 8250 printer and the water vapor transport rate was measured and calculated consistent with the procedure outlined herein. The substrate with the photo feel coating was found to have a water vapor transport rate of 6.4 g/m$^2$/12 hours, while the photo paper without such a coating had a water vapor transport rate of 1.6 g/m$^2$/12 hours. Further, a relative visual test of the stacking performance of the photo feel coated substrate was rated a 5 on a scale of 1 to 5, whereas the stacking performance of the photo paper without the photo feel coating was rated a 1 on the same scale.

While the invention has been described with reference to certain preferred embodiments, those skilled in the art will appreciate that various modifications, changes, omissions, and substitutions can be made without departing from the spirit of the invention. It is intended, therefore, that the invention be limited only by the scope of the following claims.

What is claimed is:

1. A coated substrate for ink-jet ink printing, said coated substrate having an imaging side and an opposing back side, said imaging side comprising an ink-receiving layer coating formulated for accepting an ink-jet ink composition, and said back side comprising a curl control coating nearest the substrate and an overlaying photo feel coating formulated for providing scratch resistance when stacked on a freshly printed ink-receiving layer of previously printed coated substrate, said overlaying photo feel coating having a contact angle greater than about 90 degrees and a water vapor transport rate of greater than about 5 g/m$^2$/12 hour.

2. The substrate of claim 1, wherein the imaging side comprises a micro-porous coating.

3. The substrate of claim 1, wherein the imaging side further comprises a barrier coating nearest the substrate.

4. The substrate of claim 1, wherein the substrate is raw base paper.

5. The substrate of claim 1, wherein the curl control coating is configured to prevent curling of the substrate upon receiving an ink-jet ink.

6. The substrate of claim 1, wherein the photo feel coating comprises polymeric beads and a binder.

7. The substrate of claim 6, wherein the polymeric beads are selected from the group consisting of polyethylene, polyamide, polystyrene, polymethacrylate, polyacrylate, polypropylene, and combinations thereof.

8. The substrate of claim 6, wherein the polymeric beads are from 0.01 μm to 30 μm in size.

9. The substrate of claim 8, wherein the polymeric beads are about 5 um to about 20 um in size.

10. The substrate of claim 6, wherein the binder includes starch, protein, gelatin, modified gelatin, polyvinyl alcohol, polyvinyl acetate, styrene butadiene, modified polyvinyl alcohol, methyl cellulose, polyvinyl pyrolidone, polyethylene oxide, polyvinyl acetal, modified polyvinyl acetal, styrene/methacrylate copolymers, acrylates, methacrylates, or a combination thereof.

11. The substrate of claim 1, wherein the photo feel layer has a coating weight of about 0.5 g/m$^2$ to about 5 g/m$^2$.

12. The substrate of claim 1, wherein the photo feel layer has a contact angle of greater than about 110 degrees.

13. The substrate of claim 1, wherein the photo feel layer has a vapor transport rate of greater than about 20 g/m$^2$/12 hour.

14. The substrate of claim 13, wherein the photo feel layer has a vapor transport rate of greater than about 30 g/m$^2$/12 hour.

15. The substrate of claim 1, wherein the coated substrate is ink jet media.

16. The substrate of claim 15, wherein the ink jet media is photo paper.

17. The substrate of claim 16, wherein the photo paper is glossy or semi-glossy.

18. The substrate of claim 1, wherein the substrate is configured to absorb moisture.

19. A method for making a printing media for ink-jet printing, comprising:

a) applying an ink-receiving layer on an imaging side of a substrate;

b) applying a curl control layer to an opposing back side of the substrate; and c) applying a photo feel layer including polymeric beads and a binder overlying the curl control layer on the back side of the substrate, said photo feel layer having a contact angle greater than 90 degrees and a water vapor transport rate of greater than about 5 g/m$^2$/12 hour.

20. The method of claim 19, further comprising applying a barrier layer on the imaging side of the substrate and applying the ink-receiving layer on the barrier layer.

21. The method of claim 19, wherein the curl control layer and the photo feel layer are applied simultaneously.

22. The method of claim 21, wherein the curl control layer and the photo feel layer are applied using a multi-layer curtain coater or cascade coater.

23. The method of claim 19, wherein the curl control layer and the photo feel layer are applied in a two-pass coating process.

24. The method of claim 23, wherein the two-pass coating process is selected from the group consisting of spray coating, dip coating, cascade coating, rod coating, roll coating, blade coating, slot die coating, curtain coating, air knife coating, and combinations thereof.

25. The method of claim 19, wherein the photo feel layer is applied to a coating weight of about 0.5 g/m$^2$ to about 5 g/m$^2$.

26. The method of claim 19, wherein the curl control layer is applied to a coating weight of about 15 g/m$^2$ to about 50 g/m$^2$.

27. The method of claim 19, wherein the photo feel layer has water vapor transport rate of greater than about 20 g/m$^2$/12 hour.

* * * * *

UNITED STATES PATENT AND TRADEMARK OFFICE

CERTIFICATE OF CORRECTION

PATENT NO. : 8,021,725 B2
APPLICATION NO. : 11/726864
DATED : September 20, 2011
INVENTOR(S) : Xulong Fu et al.

It is certified that error appears in the above-identified patent and that said Letters Patent is hereby corrected as shown below:

In column 8, line 2, in Claim 9, delete "um" and insert -- μm --, therefor.

In column 8, line 2, in Claim 9, delete "um" and insert -- μm --, therefor.

In column 8, line 6, in Claim 10, delete "pyrolidone," and insert -- pyrrolidone, --, therefor.

Signed and Sealed this
Fifteenth Day of May, 2012

David J. Kappos

David J. Kappos
*Director of the United States Patent and Trademark Office*